US010610455B1

(12) United States Patent
Wang

(10) Patent No.: US 10,610,455 B1
(45) Date of Patent: Apr. 7, 2020

(54) PILL BOX WITH PILL GUIDING PORTION

(71) Applicant: Meng-Chun Wang, Taichung (TW)

(72) Inventor: Meng-Chun Wang, Taichung (TW)

( * ) Notice: Subject to any disclaimer, the term of this patent is extended or adjusted under 35 U.S.C. 154(b) by 0 days.

(21) Appl. No.: 16/185,607

(22) Filed: Nov. 9, 2018

(51) Int. Cl.
*A61J 7/00* (2006.01)
*B65D 83/04* (2006.01)

(52) U.S. Cl.
CPC ..... *A61J 7/0084* (2013.01); *B65D 83/0481* (2013.01)

(58) Field of Classification Search
CPC ..... A61J 7/00; A61J 7/0084; B65D 83/04; B65D 83/0418; B65D 83/0481; B65G 59/00; B65H 1/08
USPC ..... 206/535, 536, 540; 221/197, 198
See application file for complete search history.

(56) References Cited

U.S. PATENT DOCUMENTS 2,788,891 A * 4/1957 Taylor ..... B65D 83/0454 206/536
4,171,753 A * 10/1979 Vreede ..... B65D 83/0418 206/536
4,589,575 A * 5/1986 Rigberg ..... B65D 83/0418 206/535
4,986,442 A * 1/1991 Hinterreiter ..... B65D 83/0418 221/197
5,118,007 A * 6/1992 Lewis ..... B65D 83/0418 206/535
5,388,698 A * 2/1995 Wakao ..... A61J 7/0076 206/499
8,523,011 B2 * 9/2013 Haas ..... B65D 83/0418 206/540
2007/0125794 A1 * 6/2007 Jones ..... G07F 11/14 221/231

* cited by examiner

*Primary Examiner* — Bryon P Gehman
(74) *Attorney, Agent, or Firm* — Muncy, Geissler, Olds & Lowe, PC

(57) ABSTRACT

A pill box is provided, including a main body, having an elongated hole, the elongated hole including an inlet end portion and an outlet end portion which are open toward two different sides of the main body, the main body further including a pill guiding portion which protrudes outwardly and a cap portion, the pill guiding portion having a guiding opening, the cap portion openably covering the guiding opening; a plurality of case bodies, each of the plurality of case bodies movably engaged and positionable in the elongated hole, each of the plurality of case bodies including an opening communicable with the guiding opening when located close to the guiding opening.

9 Claims, 11 Drawing Sheets

PILL BOX WITH PILL GUIDING PORTION

BACKGROUND OF THE INVENTION

Field of the Invention

The present invention relates to a pill box.

Description of the Prior Art

In the modern society, people have a lot of pressure from work and irregular life schedule, they are easy to get sick, and there are more and more people suffer from chronic diseases year by year. Usually, after going to the hospital/clinic, patients get prescribed medicines that they should take daily; however, the medicines are often put in plastic bags and prone to damp and deterioration.

Therefore, there are various kinds of pill boxes on the market for separating and storing the pills according to different requirements. In the prior arts, the pill box includes a case body and a cap body which cover the case body, and the case body is split into a plurality of receiving grooves for receiving pills. However, the plurality of receiving grooves of the pill box are integrally formed on a same plane, so the pill box has a greater volume, and it is not easy for people to store the pill box or carry the pill box around.

The present invention has arisen to mitigate and/or obviate the afore-described disadvantages.

SUMMARY OF THE INVENTION

The major object of the present invention is to provide a pill box which is easy for a user to store, use and carry around.

To achieve the above and other objects, a pill box is provided, including a main body, having an elongated hole, the elongated hole including an inlet end portion and an outlet end portion which are open toward two different sides of the main body, the main body further including a pill guiding portion which protrudes outwardly and a cap portion, the pill guiding portion having a guiding opening, the cap portion openably covering the guiding opening; a plurality of case bodies, each of the plurality of case bodies movably and radially abutting against the elongated hole to be positioned therein, each of the plurality of case bodies including an opening, the opening communicating with the guiding opening.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
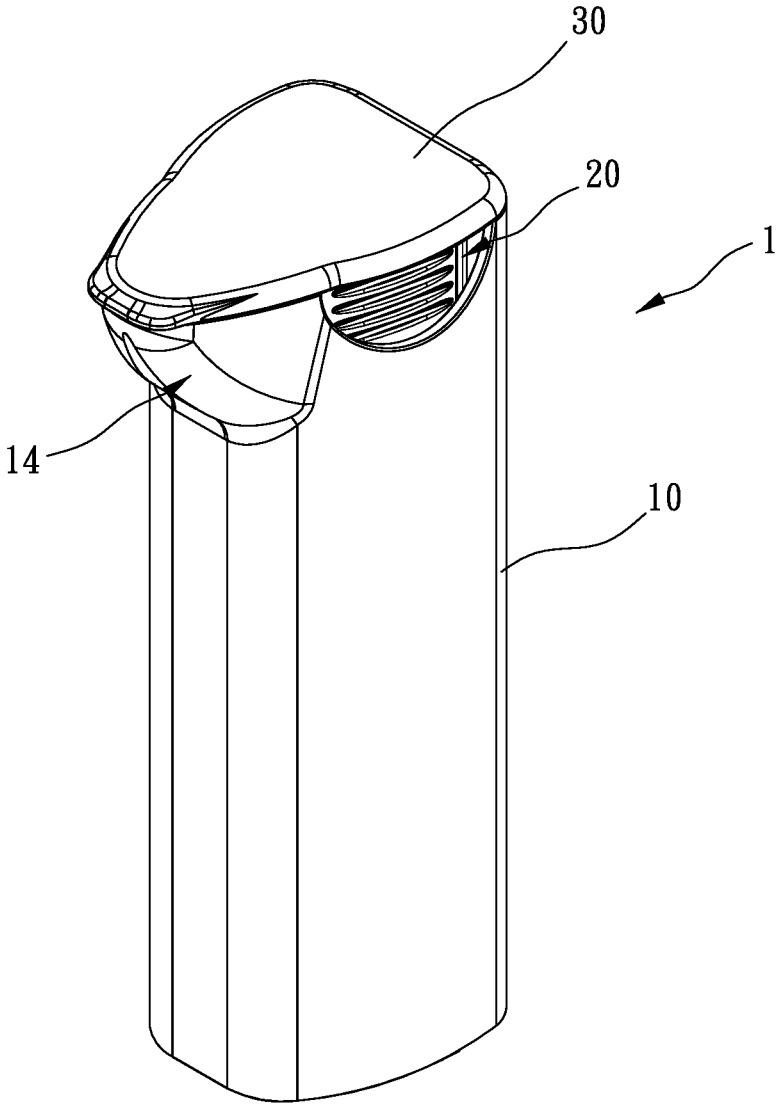
FIG. 1 is a stereogram of a first preferred embodiment of the present invention.
Figure 2:
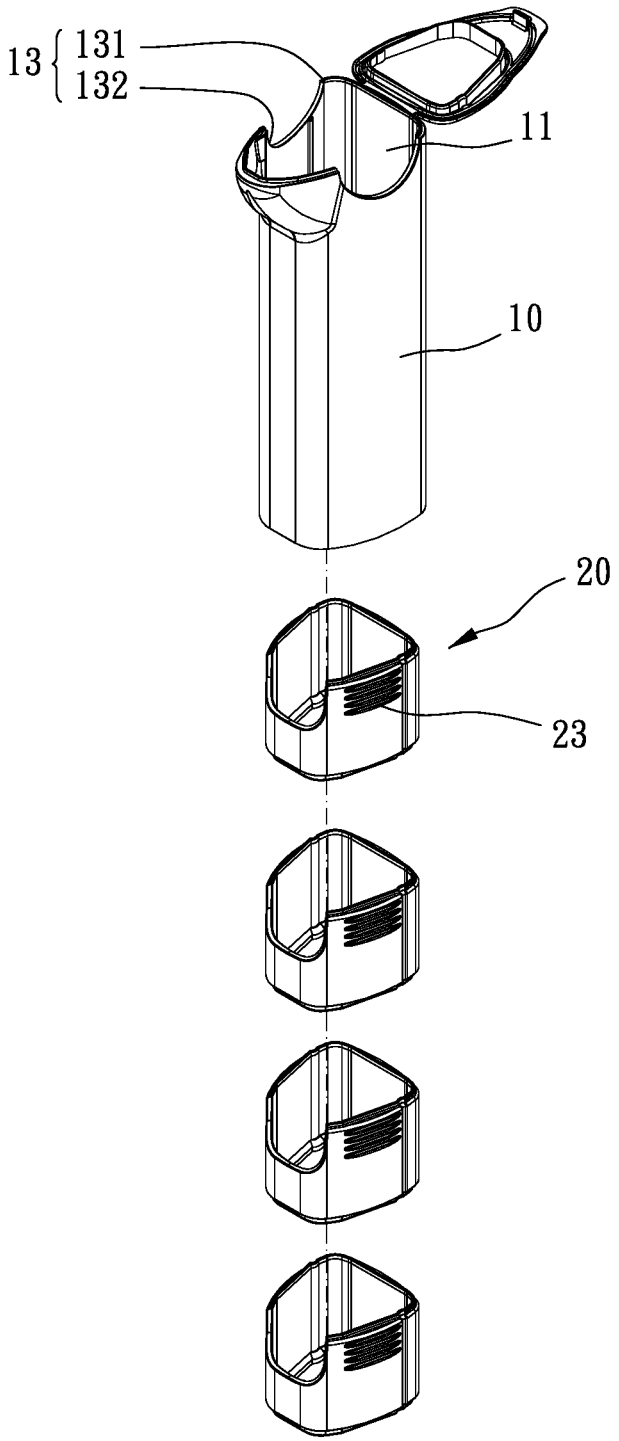
FIG. 2 is a breakdown view of the first preferred embodiment of the present invention.
Figure 3:
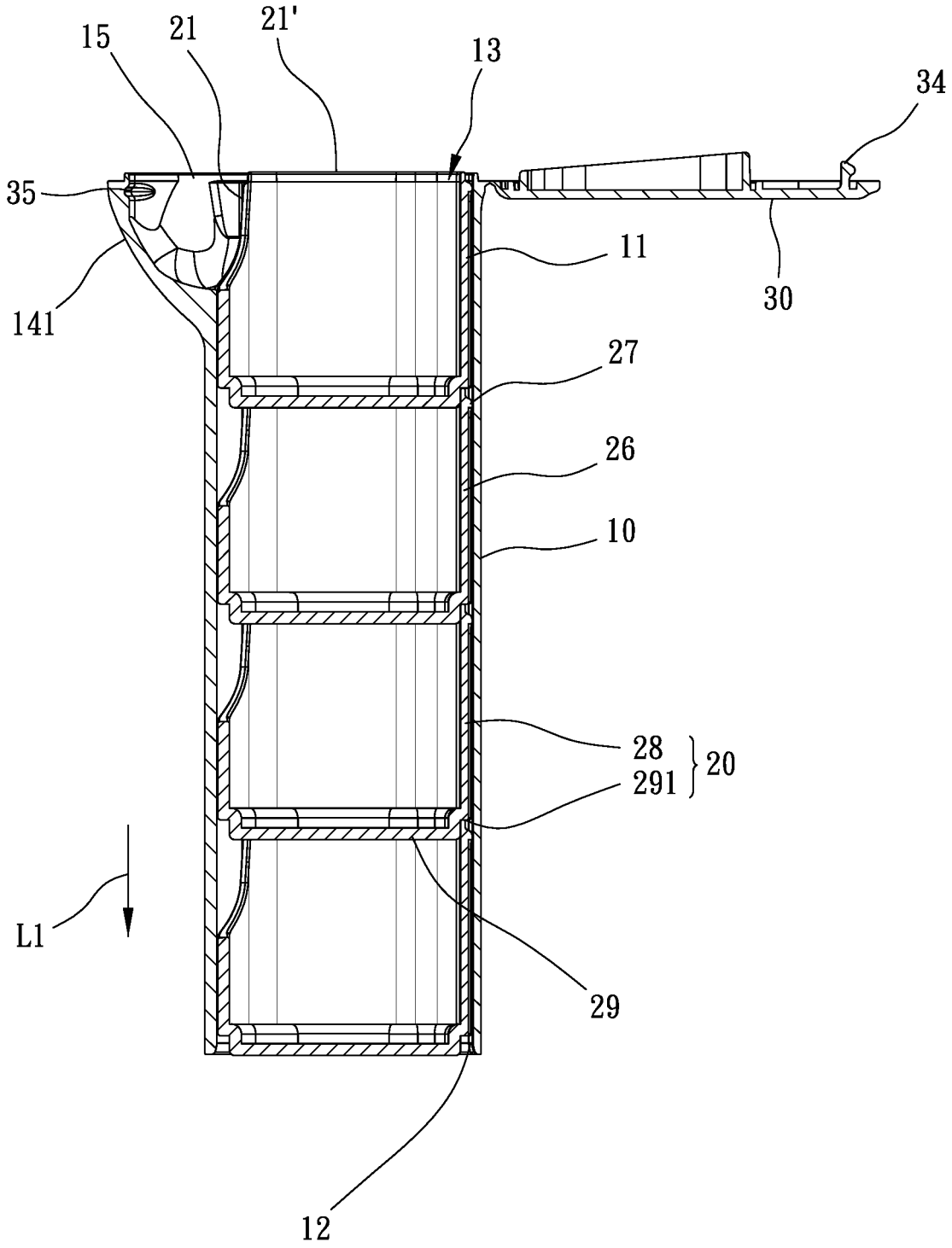
FIG. 3 is a cross-sectional view of the first preferred embodiment of the present invention.
Figure 4:
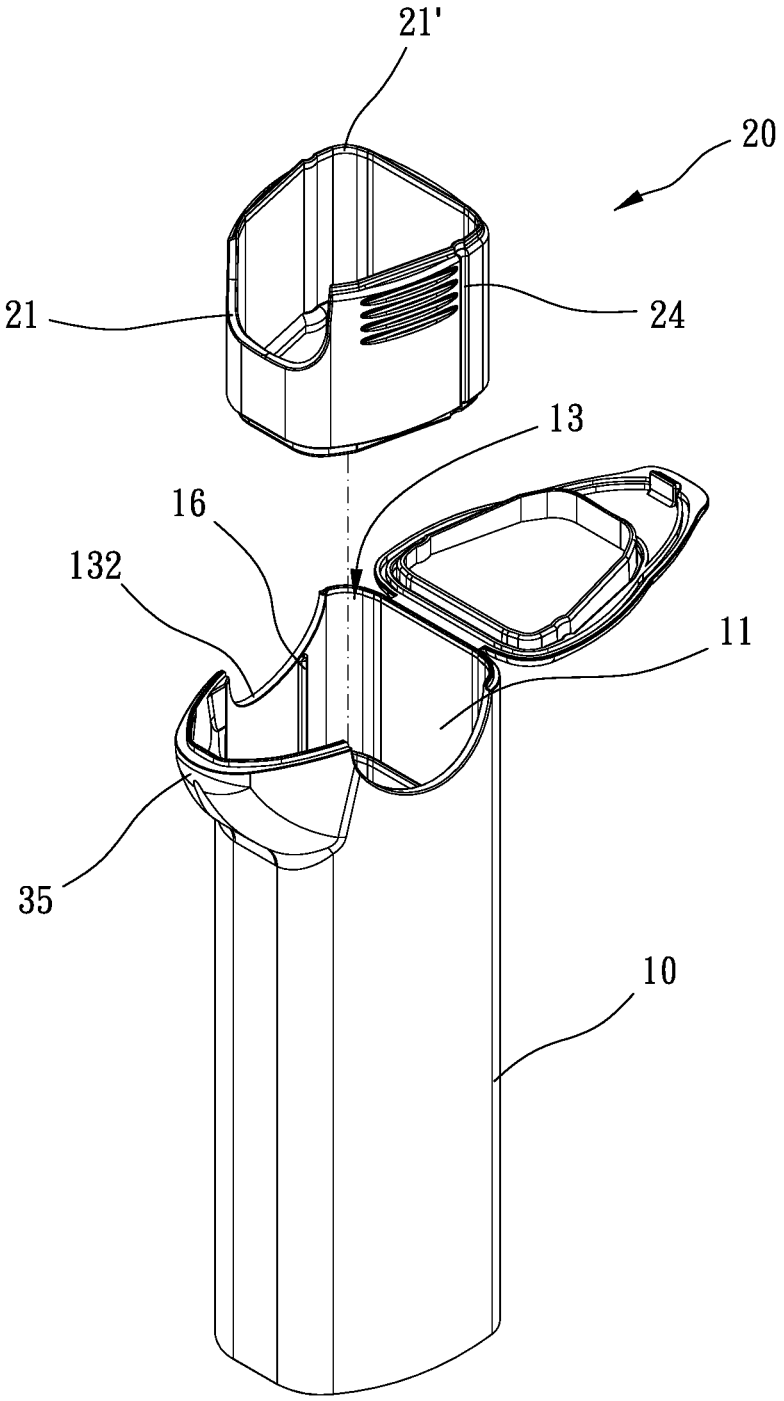
FIG. 4 is another breakdown view of the first preferred embodiment of the present invention.
Figure 5:
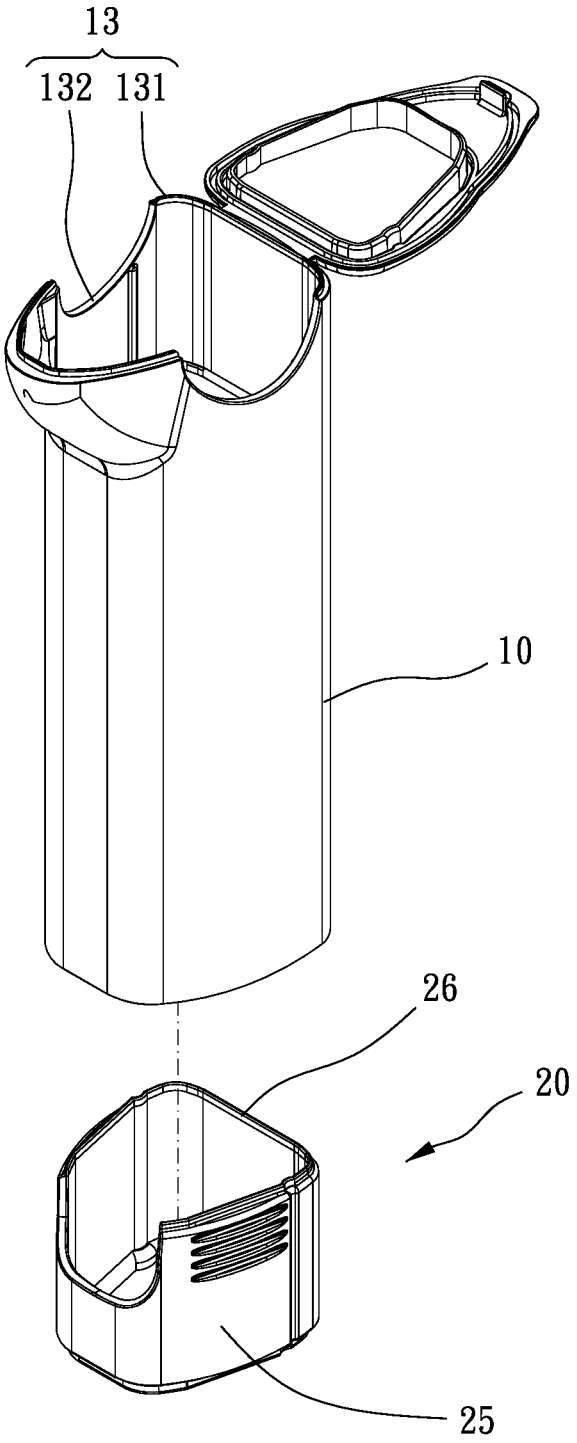
FIG. 5 is still another breakdown view of the first preferred embodiment of the present invention.
Figure 6:
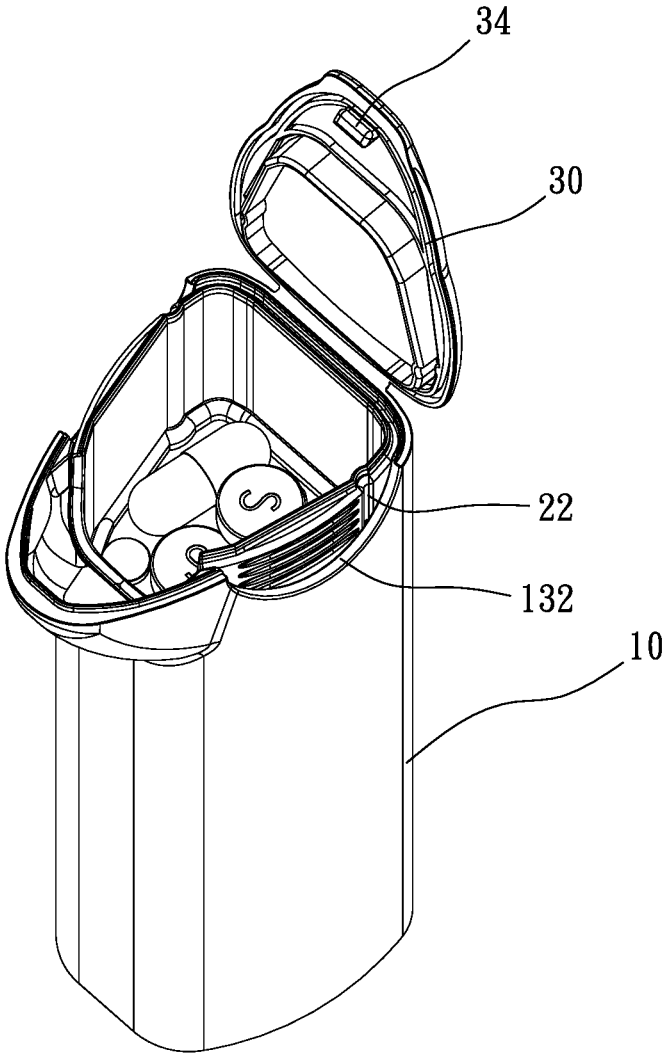
FIG. 6 is a drawing showing the first preferred embodiment of the present invention in use.

Please refer to FIGS. 1 to 6 for a first preferred embodiment of the present invention. A pill box 1 includes a main body 10 and a plurality of case bodies 20.

The main body 10 has an elongated hole 11, the elongated hole 11 includes an inlet end portion 12 and an outlet end portion 13 which are open toward two different sides of the main body 10, the main body 10 further includes a pill guiding portion 14 which protrudes outwardly and a cap portion 30, the pill guiding portion 14 has a guiding opening 15, the cap portion 30 openably covers the guiding opening 15, and the main body 10 is made of plastic; each of the plurality of case bodies 20 is movably engaged and positionable in the elongated hole 11, each of the plurality of case bodies 20 is made of a plastic material which is deformable, an exterior circumference of each of the plurality of case bodies 20 is made of a flexible material, and each of the plurality of case bodies 20 is a transparent box; each of the plurality of case bodies 20 includes an opening, and the opening is communicable with the guiding opening 15 when located close to the guiding opening 15 for pills to be poured out from the guiding opening 15; therefore, the pill box 1 has a small volume which is easy for a user to store and carry around, and the pill box 1 is for categorize the pills. In this embodiment, the elongated hole 11 extends in a first direction L1, the first direction L1 passes the inlet end portion 12 and the outlet end portion 13, the elongated hole 11 directly biases each of the plurality of case bodies 20 on the inlet end portion 12 to drive one of the plurality of case bodies 20 to outlet from the outlet end portion 13; the pill guiding portion 14 extends and protrudes laterally relative to the first direction L1, so the pill guiding portion 14 can be tilted and pour out pills; preferably, the pill guiding portion 14 has an exterior curved protrusive face 141.

In this embodiment, the cap portion is pivoted to the main body 10; in other embodiments, the cap portion may be directly engaged with the main body. The cap portion 30 covers the inlet end portion 12 and the guiding opening 15. One of the cap portion 30 and the main body 10 has a buckle hole, and the other of the cap portion 30 and the main body 10 has a buckle rib which detachably buckles the buckle hole; in this embodiment, the cap portion 30 has the buckle rib 34 (barb-shaped), and the main body 10 has the buckle hole 35.

The outlet end portion 13 includes an exit 131 and at least one side opening 132, an open direction of the exit 131 and an open direction of the at least one side opening 132 are different, and each of the plurality of case bodies 20 has at least one side portion 22 which is exposable from one of the at least one side opening 132; in this embodiment, a number of the at least one side openings 132 is two, and the two side openings 132 are disposed on two opposite sides of the outlet end portion 13 and open laterally relative to the first direction L1. Preferably, the at least one side portion 22 has an anti-slip structure 23; the anti-slip structure 23 is composed of a plurality of protrusive blocks, and each of the plurality of protrusive blocks is lateral to an open direction of the inlet end portion 12; in other embodiments, the anti-slip structure may be a rough surface, an anti-slip surface which has a high friction coefficient, a height-differentiated structure and others.

An exterior circumferential wall of each of the plurality of case bodies 20 has at least one first guide rail 24, an interior circumferential wall of the main body 10 has at least one second guide rail 16, each of the at least one first guide rail 24 is in male-female connection with the at least one second guide rail 16, in this embodiment, each of the at least one first rail 24 is a protrusive rail, and each other of the at least one second guide rail 16 is a rail groove; in this embodiment, the at least one first guide rail 24 is plural, and each of the at least one first guide rail 24 extends in the first direction L1 so that each of the plurality of case bodies 20 can stably and smoothly move within the elongated hole 11. In addition, the exterior circumferential wall of each of plurality of case bodies 20 includes two curved protrusive walls 25 which are disposed opposite to each other, and the two curved protrusive walls 25 are respectively curve outwardly, and the at least one first guide rail 24 is disposed on one of the two curved protrusive walls 25 so as to radially abut against and positioned by a wall of the elongated hole 11. Preferably, the exterior circumferential wall of each of plurality of case bodies 20 further includes a connection wall 26, the connection wall 26 is connected to and between the two curved protrusive walls 25, and the connection wall 26 has a protrusion 27 which is abuttable against the main body 10 to elevate a positioning effect. Specifically, each of the plurality of case bodies 20 includes a receiving section 28, a connecting section 29 and a shoulder portion 291 which is located between the receiving section 28 and the connecting section 29, a number of the opening is two, the receiving section 28 includes the two openings 21, 21', the two openings 21, 21' open toward different directions, specifically, and the opening 21' open toward the first direction L1; the connecting section 29 is protrusible into the opening 21 or the opening 21', and the shoulder portion 291 is abuttable against an edge of the opening 21 or an edge of the opening 21'; in this embodiment, the connecting section 29 protrudes into the opening 21' to position each other so that the connecting section 29 will not deviate from the opening 21' easily; in other embodiments, the connecting section may have an engaging groove, and a top of the receiving section is engaged within the engaging groove.

Figure 7:
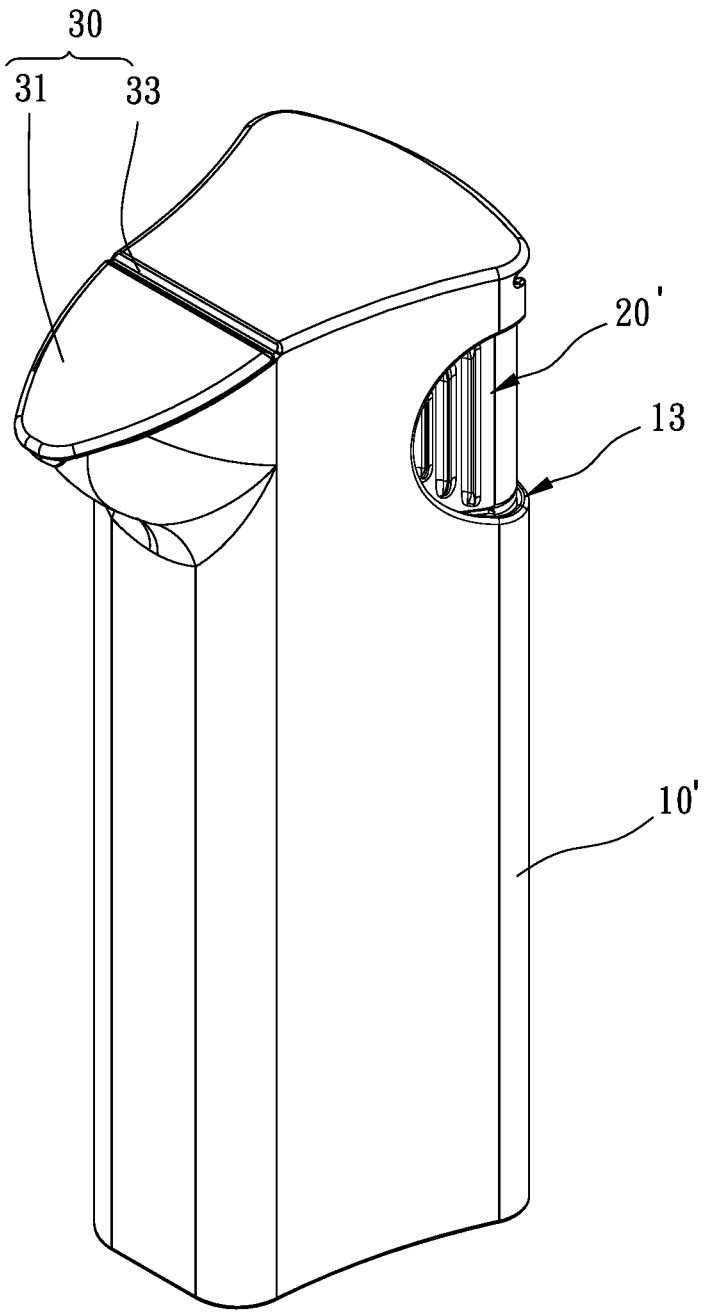
FIG. 7 is a stereogram of a second preferred embodiment of the present invention.
Figure 8:
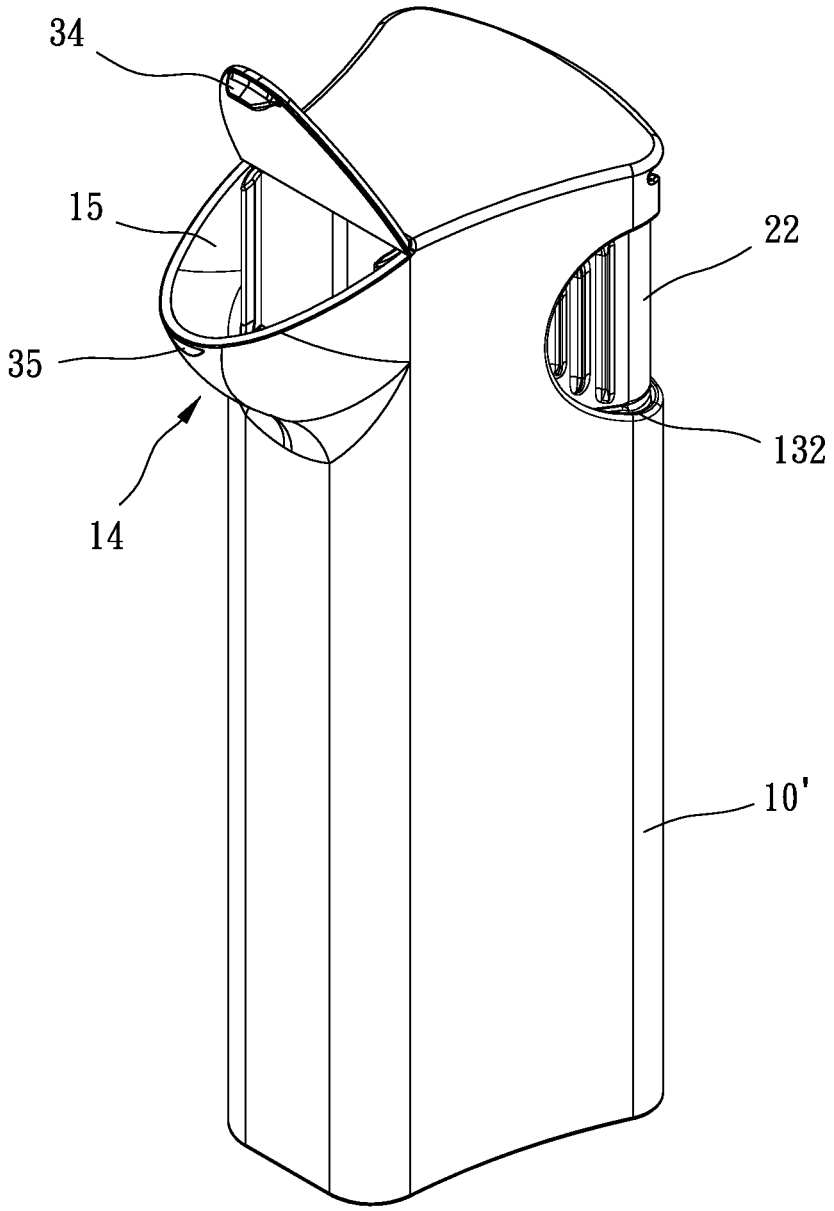
FIG. 8 is a drawing showing the second preferred embodiment of the present invention.
Figure 9:
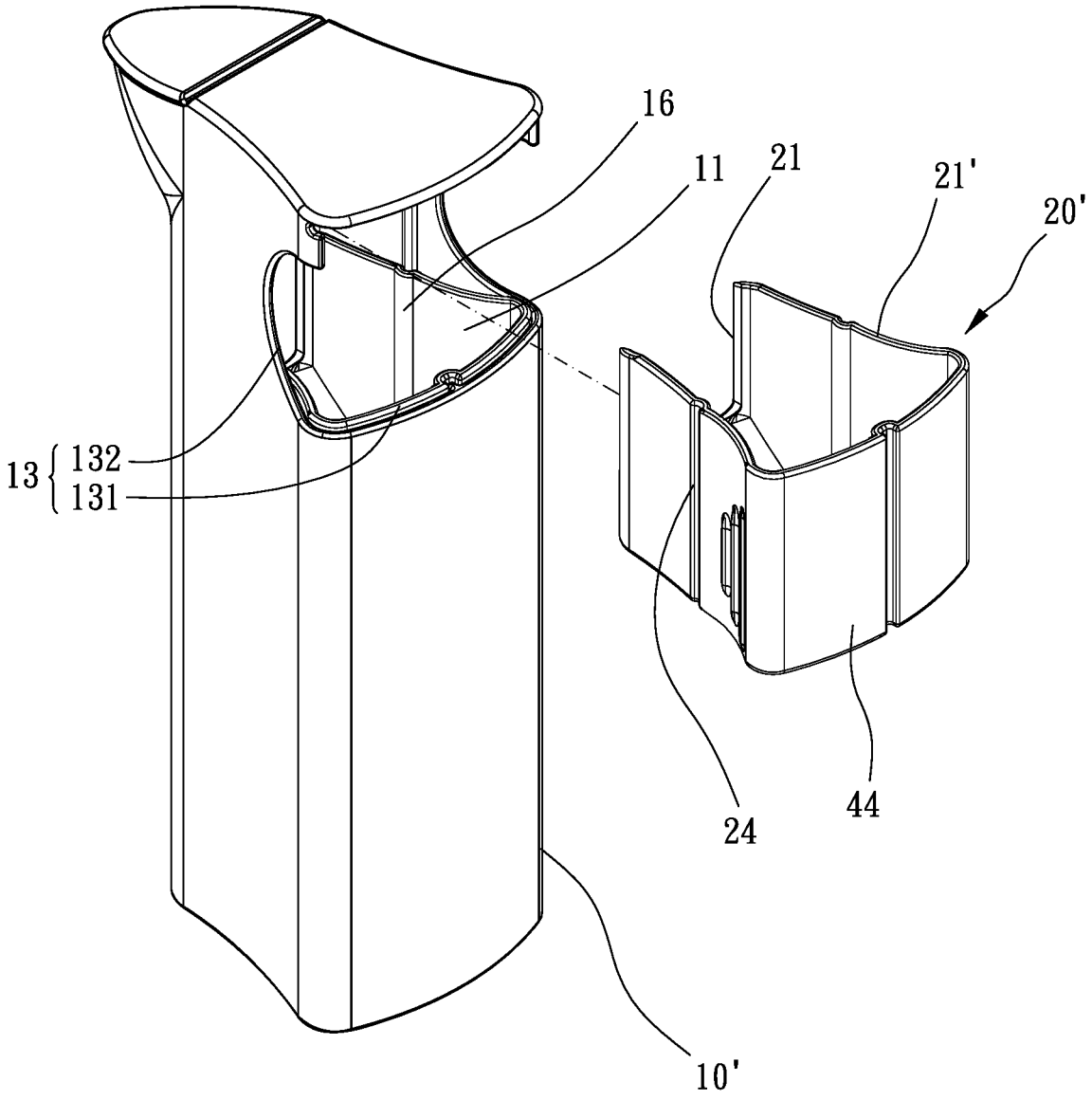
FIG. 9 is a breakdown view of the second preferred embodiment of the present invention.
Figure 10:
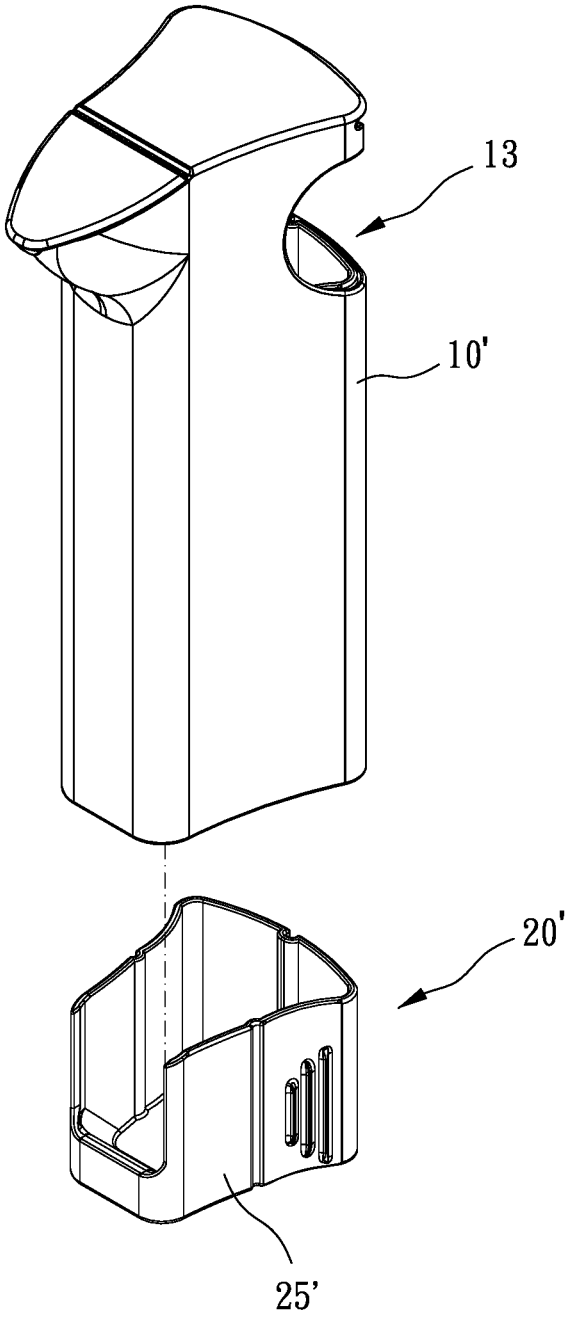
FIG. 10 is another breakdown view of the second preferred embodiment of the present invention.
Figure 11:
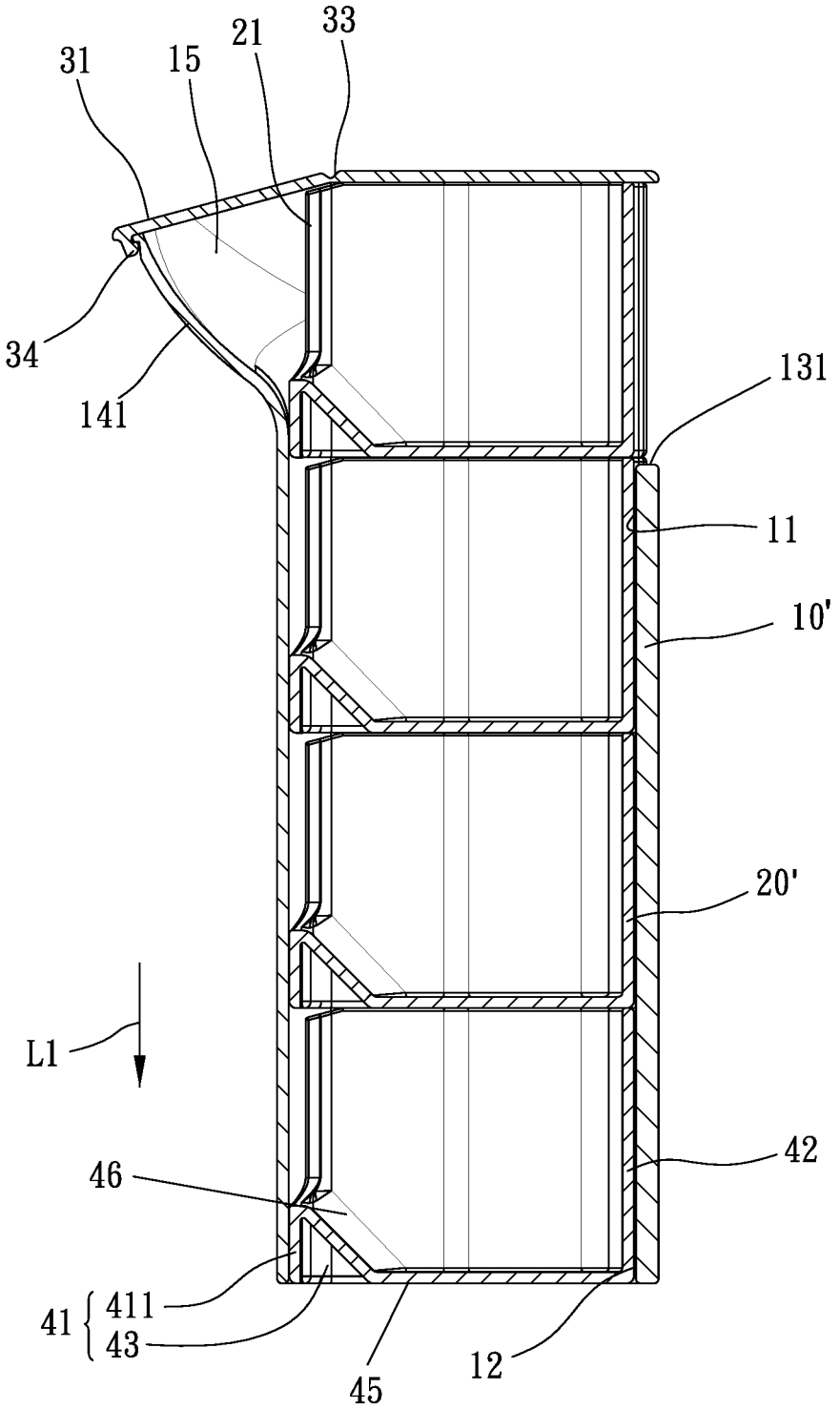
FIG. 11 is a cross-sectional view of the second preferred embodiment of the present invention.

Please refer to FIGS. 7 to 11 for a second preferred embodiment. Compared with the first preferred embodiment, in the second preferred embodiment, the first direction L1 passes the inlet end portion 12, the outlet end portion 13 open laterally relative to the first direction L1, and the pill guiding portion 14 extends and protrudes laterally relative to the first direction L1 so that each of the plurality of case bodies 20' can be directly disassembled laterally. In addition, the cap portion 30 includes a groove 33 and a first cap portion 31 which is swingable relative to the groove 33 and the guiding opening 15 so as to cover or uncover the guiding opening 14.

The exterior circumferential wall of each of the plurality of case bodies 20' includes two concave walls 25' which are opposite to each other, the two concave walls 25' curve toward two opposite directions, and the at least one first guide rail 24 is disposed on one of the two concave walls 25' so that each of the plurality of case bodies 20' can be easily assembled to or disassembled from the main body 10'. Specifically, the exterior circumferential wall of each of the plurality of case bodies 20' further includes a front wall section 41 and a rear wall section 42 which are disposed on two opposite sides, the front wall section 41 has an abutting face 411 and a compression space 43 which corresponds to the abutting face 411, and in this embodiment, the compression space 43 is a blind groove; in other embodiments, the compression space may be a through hole or filled with an elastic material which has an elastic coefficient different from the abutting face; the rear wall section 42 has an curved protrusive face 44 which protrudes outwardly so that the rear wall section 42 can be stably abutted and positioned. In addition, the case body 20' further includes a bottom face 45 which is connected to the front wall section 41 and the rear wall section 42 and a slant guide face 46 which is connected to the front wall section 41 and the bottom face 45, the opening 21 is disposed on the front wall section 41, and the slant guide face 46 is lateral to an open direction of the opening 21 so as to guide, for example, pills from the case body 20' to be smoothly poured out of the guiding opening 15.

Furthermore, in the first direction L1, the opening 21 of each of the plurality of case bodies 20' is overlappable with the guiding opening 15 in a range equal to or more than ⅔ of the guiding opening 15.

In addition, the first direction L1 extends from the outlet end portion 13 toward the inlet end portion 12, and as viewed in the first direction L1, and each of the plurality of case bodies 20' is substantially U-shaped so that the plurality of case bodies 20' are deformable and easy to be assembled to or disassembled from the main body 10'.

In practice, the plurality of case bodies 20, 20' are piled up within the elongated hole 11 to be abutted and positioned within the elongated hole 11, and a force pushes the plurality of case bodies 20, 20' to move from the inlet end portion 12 to move to the outlet end portion 13 so that each of the plurality of case bodies 20, 20' can be taken out and put back into the main body 10, 10' again.

Given the above, the pill box has a simple structure and provides positioning effect. The pill box has a small volume, so it is convenient for the user to store and carry around and to categorize pills.

While we have shown and described various embodiments in accordance with the present invention, it should be clear to those skilled in the art that further embodiments may be made without departing from the scope of the present invention.

What is claimed is:

1. A pill box, including:

a main body, having an elongated hole, the elongated hole including an inlet end portion and an outlet end portion which are open toward two different sides of the main body, the main body further including a pill guiding portion which protrudes outwardly and a cap portion, the pill guiding portion having a guiding opening, the cap portion openably covering the guiding opening;

a plurality of case bodies, each of the plurality of case bodies movably engaged and positionable in the elongated hole, each of the plurality of case bodies including an opening communicable with the guiding opening when located close to the guiding opening;

wherein the outlet end portion includes an exit and at least one side opening, the exit and the at least one side opening are open at different sides of the outlet end portion and are in a fixed spatial relationship, and each of the plurality of case bodies has at least one side portion which is exposable from one of the at least one side opening;

wherein the elongated hole extends in a first direction, relative to the first direction the at least one side opening is disposed laterally through at least one side of the outlet end portion which faces toward a direction transverse to a direction in which the pill guiding portion laterally protrudes.

2. The pill box of claim 1, wherein the main body is integrally formed of one piece, the first direction extends from the inlet end portion to the outlet end portion, and the pill guiding portion extends and protrudes laterally relative to the first direction.

3. The pill box of claim 2, wherein the cap portion covers the inlet end portion and the guiding opening.

4. The pill box of claim 3, wherein the at least one side portion has an anti-slip structure; the anti-slip structure is composed of a plurality of protrusive blocks, and each of the plurality of protrusive blocks protrudes laterally; an exterior circumferential wall of each of the plurality of case bodies has at least one first guide rail, an interior circumferential wall of the main body has at least one second guide rail, and each of the at least one first guide rail is in male-female connection with the at least one second guide rail; the at least one first guide rail is plural, and each of the at least one first guide rail extends in the first direction; the exterior circumferential wall of each of plurality of case bodies includes two curved protrusive walls which are disposed opposite to each other; the exterior circumferential wall of each of plurality of case bodies further includes a connection wall, the connection wall is connected to and between the two curved protrusive walls, and the connection wall has a protrusion which is abuttable against the main body; one of the cap portion and the main body has a buckle hole, and the other of the cap portion and the main body has a buckle rib which is detachably engaged within the buckle hole; each of the plurality of case bodies includes a receiving section, a connecting section and a shoulder portion which is located between the receiving section and the connecting section, a number of the opening is two, the receiving section includes the two openings, the two openings are open at different sides of the receiving section, the connecting section is protrusible into one of the two openings, and the shoulder portion is abuttable against an edge of one of the two openings; the pill guiding portion has an exterior curved protrusive face.

5. The pill box of claim 1, wherein the main body is integrally formed of one piece, the first direction extends from the inlet end portion, and the outlet end portion opens laterally relative to the first direction, and the pill guiding portion extends and protrudes laterally relative to the first direction.

6. The pill box of claim 5, wherein the cap portion includes a groove and a first cap portion which is swingable relative to the groove and the guiding opening.

7. The pill box of claim 6, wherein the at least one side portion has an anti-slip structure; the anti-slip structure is composed of a plurality of protrusive blocks, and each of the plurality of protrusive blocks protrudes laterally; an exterior circumferential wall of each of the plurality of case bodies has at least one first guide rail, an interior circumferential wall of the main body has at least one second guide rail, and each of the at least one first guide rail is in male-female connection with the at least one second guide rail; the at least one first guide rail is plural, and each of the at least one first guide rail extends in the first direction; the exterior circumferential wall of each of plurality of case bodies includes two curved protrusive walls which are disposed opposite to each other, and the at least one first guide rail is disposed on one of the two curved protrusive walls; the exterior circumferential wall of each of the plurality of case bodies further includes a front wall section and a rear wall section which are disposed on two opposite sides, and the front wall section has an abutting face and a compression space which corresponds to the abutting face; the rear wall section has an curved protrusive face which protrudes outwardly; one of the cap portion and the main body has a buckle hole, and the other of the cap portion and the main body has a buckle rib which is detachably engaged within the buckle hole; the pill guiding portion has an exterior curved protrusive face; the case body further includes a bottom face which is connected to the front wall section and the rear wall section and a slant guide face which is connected to the front wall section and the bottom face, and the opening is disposed on the front wall section; in the first direction, the opening of each of the plurality of case bodies is overlappable with the guiding opening in a range equal to or more than two-thirds of the guiding opening; the first direction extends from the outlet end portion toward the inlet end portion, and as viewed in the first direction, each of the plurality of case bodies is substantially U-shaped.

8. The pill box of claim 1, wherein the main body is integrally formed of one piece, an exterior circumferential wall of each of the plurality of case bodies has at least one first guide rail, an interior circumferential wall of the main body has at least one second guide rail, and each of the at least one first guide rail is in male-female connection with the at least one second guide rail.

9. The pill box of claim 8, wherein the exterior circumferential wall of each of the plurality of case bodies includes two concave walls which are opposite to each other, the two concave walls curve toward two opposite directions, and the at least one first guide rail is disposed on one of the two concave walls.

* * * * *